United States Patent [19]

Kissel

[11] Patent Number: 4,690,580

[45] Date of Patent: Sep. 1, 1987

[54] RING BINDER MECHANISM WITH MATING RINGS

[75] Inventor: Karl-Heinz Kissel, Espelkamp, Fed. Rep. of Germany

[73] Assignee: Robert Krause GmbH & Co. KG, Espelkamp, Fed. Rep. of Germany

[21] Appl. No.: 769,530

[22] Filed: Aug. 26, 1985

[30] Foreign Application Priority Data

Sep. 8, 1984 [DE] Fed. Rep. of Germany ..... 3433124

[51] Int. Cl.[4] ..... B42F 13/20; B42F 13/22; B42F 13/30

[52] U.S. Cl. ..... 402/39; 402/31

[58] Field of Search ..... 402/20, 31, 39, 56, 402/29, 501

[56] References Cited

U.S. PATENT DOCUMENTS

| | | | |
|---|---|---|---|
| 724,849 | 4/1903 | Gresham | 402/56 |
| 778,992 | 1/1905 | Nelson | 402/56 |
| 854,303 | 5/1907 | Nethery | 402/56 |
| 2,119,639 | 6/1938 | Lotter | 402/31 |
| 3,246,653 | 4/1966 | Sexton | 402/15 |
| 3,833,308 | 9/1974 | Seaborn | 402/56 |

FOREIGN PATENT DOCUMENTS

| | | | |
|---|---|---|---|
| 0503023 | 7/1930 | Fed. Rep. of Germany | 402/29 |
| 6413025 | 5/1965 | Netherlands | 402/31 |
| 190860 | 11/1929 | United Kingdom | 402/39 |
| 1210741 | 10/1970 | United Kingdom | 402/20 |

*Primary Examiner*—Howard N. Goldberg
*Assistant Examiner*—Taylor J. Ross
*Attorney, Agent, or Firm*—Jordan and Hamburg

[57] ABSTRACT

The ring binder mechanism comprises a resilient mechanism cover which can be connected to the spine of a binder or cover, two toggle plates or toggle rods which are articulately connected in opposite senses and which are resiliently supported in the mechanism cover, and ring portions which cooperate in pairs to form rings and which are carried by the toggle plates or toggle rods, consist of drawn or rolled metal wire of non-round cross-section and have ends which positively interengage locally in the closed position. At their free ends, the ring portions have plane end faces which bear snugly against one another in the closed position and one ring portion of each pair of ring portions having a pin which is cylindrical over at least its main length and which projects perpendicularly from the end face and the other ring portion having a bore which is cylindrical over at least its main length and is sunk perpendicularly in the end face.

4 Claims, 6 Drawing Figures

RING BINDER MECHANISM WITH MATING RINGS

The invention relates to a ring binder mechanism of the type in which each ring comprises two ring portions biased towards each other. In know ring binder mechanisms of this type, the free ends of the ring portions have interengaging teeth, without a gap, so that the ends of the ring portions, pressed against one another by the spring tension of the mechanism cover, are self-aligning. Although such a construction permits economical manufacture, nevertheless it has the disadvantage that a displacement of the ends of the ring portions transversely to the plane of adjustment is possible. In ring binder mechanisms with a relatively large capacity for perforated written material, wherein the ring portions have correspondingly large dimensions, the spring prestressing of the mechanism cover is often not sufficient to press the two ring portions reliably against one another and to secure them against becoming disengaged from the opposite teeth.

Furthermore, ring binder mechanism of this type are known with ring portions of metal wire of round cross-section wherein one ring portion of each pair of ring portions is chamfered in a taper at its end and the end of the other ring portion is provided with a tapered recess. It is true that the positive engagement of such ring-portion ends ensures a mutual adjustment of the ringportion ends in all directions but the pressure exerted by the mechanism cover on the ends of the ring portions is not sufficient reliably to prevent mutual disengagement in the event of pressure transverse to the plane of the ring portions. This also applies to ring mechanisms wherein ring portions of non-round cross-section are injection moulded from plastics material and provided with a tapered extension or a tapered bore at the end. Apart from this, plastics ring portions have little inherent stability which encourages displacement of the ends of the ring portions.

It is the object of the invention to provide a ring binder mechanism of the type referred to wherein the ring portions are reliably adjusted on all sides in their closed position even with heavy loading and are secured against opening of the ring closure by displacement of the ends of the ring portions.

The present invention is a ring binder mechanism consisting of a resilient mechanism cover which can be connected to a spine or cover, two toggle plates or toggle rods which are articulately connected in opposite directions and which are resiliently supported in the mechanism cover, and ring portions which cooperate in pairs to form rings, which are carried by toggle plates or toggle rods, which consist of drawn or rolled metal wire with a non-round cross-section and which have ends which positively interengage locally in the closed position, the ring portions having, at their free ends, plane end faces which bear snugly against one another in the closed position, one of the ring portions of each pair of ring portions having a pin which is cylindrical over at least its main length and which projects perpendicularly from the end face and the other ring portion having a bore which is cylindrical over at least its main length and is sunk perpendicularly into the end face.

An embodiment of the present invention will now be described, by way of example, with reference to the accompanying drawing, in which.

Figure 1:
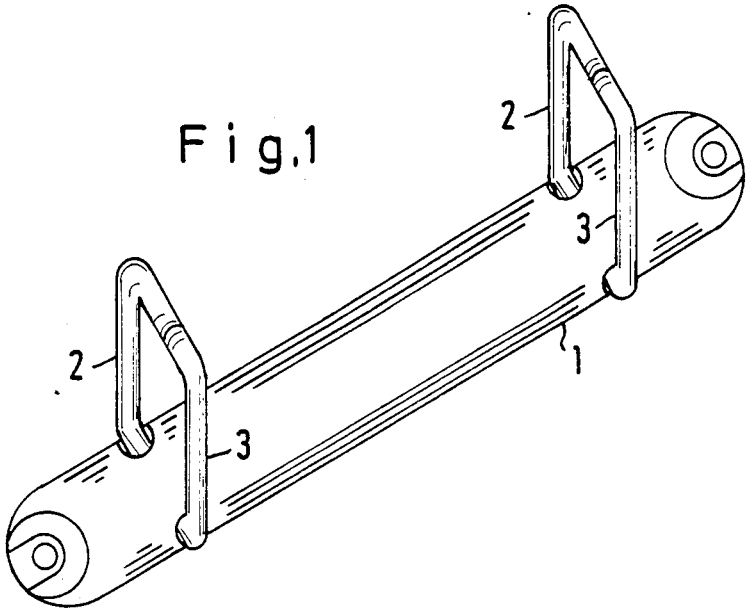
FIG. 1 shows a perspective general view of a ring binder mechanism according to the invention.
Figure 2:
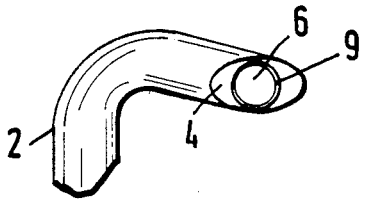
FIGS. 2 and 3 show broken away, perspective views of the ends of the ring portions of a pair of ring portions.
Figure 3:
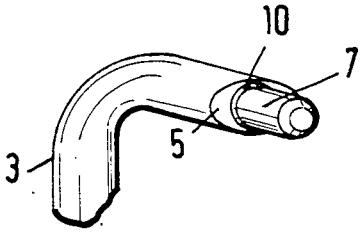
Figure 4:
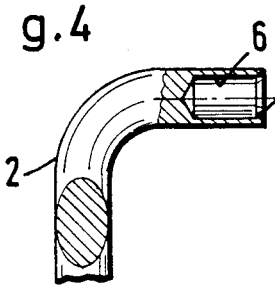
FIGS. 4 and 5 show broken away side views of the ring portions of a pair of ring portions, partly in section.
Figure 5:
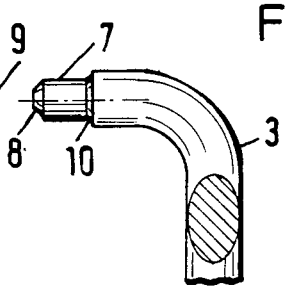

The ring binder mechanism consists, in detail, of a resilient mechanism cover 1 which is prepared, at its ends, for attachment as by rivetting to the spine of a binder or cover. The mechanism cover 1 conceals and engages round two toggle plates or toggle rods which are connected by a joint tilting in opposite directions and which are resilient supported in the mechanism cover 1 and carry ring portions 2, 3. The ring portions 2, 3 secured to the toggle plates or toggle rods cooperate in pairs to form rings for receiving perforated written material. The ring portions 2, 3 consist of drawn or rolled metal wire of non-round, in this embodiment oval, cross-section, as can be seen, in particular, from Figures 4 and 5. At their free ends, the ring portions 2, 3 have plane end faces 4, 5 which bear snugly against one another in the closed position of the ring portions 2, 3. The ring portion 2 comprises a bore 6, which is cylindrical at least in its main portion and is sunk perpendicularly into the end face 4, at its end, and the ring portion 3 is provided at its end with a pin 7 which is cylindrical at least in its main portion and projects perpendicularly from the end face 5.

Between the cylindrical portion of the bore 6 and the cylindrical portion of the pin 7 there is a fitting clearance which renders possible opposite tilting movement for opening and closing the ring portions 2, 3. In order to ensure that the pin 7 penetrates into the bore 6 without hindrance during a closing movement of the ring portions, the pin 7 is provided with an encircling chamfer 8 of about 45° to 60° at its front end.

Figure 6:
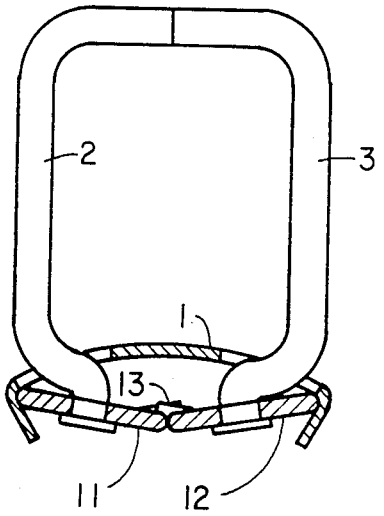
FIG. 6 is a cross sectinal view of the ring binder showing known toggle plates.

The cylindrical bore 6 may advantageously lead with an encircling chamfer 9 of about 45° into the end face 4 surrounding it. This chamfer 9 in turn facilitates the penetration of the pin 7 into the bore 6 during closing movements of the ring portions 2, 3 but in particular serves the purpose of cooperating with an encircling tapered widened portion 10 with which the pin 7 passes over into the end face 5 of its ring portion 3. The taper angle of the widened portion is also about 45° so that the chamfer 9 and widened portion 10 are in positive engagement in the closed position. As a result, the possibility of displacement transversely to the plane of the rings formed by the ring portions 2, 3, which might occur as a result of the fitting clearance, is avoided. It is true that on the action of pressure transversely to the plane of the ring portions 2, 3, a slight movement in the opening direction may result from the wedge action between the regions 9, 10 but the cylindrical regions of pin 7 and bore 6 will remain in mutual engagement and prevent further displacement. FIG. 6 shows known ring-rail parts 11,12 which support the ring portions 1,2 and which are pivotally connected by a flexing joint 13. The toggle plates 11,12 are povitably supported at their outer ends by the cover 1. Resilient mechanisms for resiliently supporting the ring portions 1,2 are well known in the prior art, for example, in U.S. Pat. Nos. 1,876,569; 1,996,463; and 3,884,586.

We claim:

1. In a ring binder mechanism of the type in which two ring sections are resiliently supported in pairs to form rings, the combination comprising pairs of ring sections having a non-round cross section, each ring section of a pair having free end portions, each of said free end portions having a terminating end face, one of said free end portions of a pair comprising a first and a second external frusto-conical portion and a cylindrical portion disposed between said first and second frusto-conical portions, said first external frusto-conical portion having its larger diameter end joined to the respective non-round ring section and its small diameter end jointed to one longitudinal end of said cylindrical portion, said smaller diameter end of said first external frusto-conical portion being equal to the diameter of said cylindrical portion and being coincident with one longitudinal end of said cylindrical portion, said second external frusto-conical portion having its smaller diameter end coincident with the terminating end face of said one free end portion and the larger diameter end equal to the diameter of said cylinder portion and coincident with the other longitudinal end of said cylindrical portion, the other of said free end portions of a pair having a cylindrical bore and an internal frusto-conical portion opening up onto said terminating end face of said other free end portion, said internal frusto-conical portion having its smaller diameter and equal to the diameter of said cylindrical bore and coincident with one longitudinal end of said cylindrical bore, said cylindrical bore having a diameter greater than the diameter of said cylindrical portion, said first external frusto-conical portion and said internal frusto-conical portion each having a cone angle of about forty-five degrees, said cylindrical portion being insertable into said cylindrical bore to a depth at which said first external frusto-conical portion mates with said internal frustoconical portion to thereby provide a frusto-conical seating surface, said second external frusto-conical portion and said internal frustoconical portion facilitating insertion of said one free end portion into said other free end portion, said frusto-conical seating surface preventing initial transverse displacement between said one and said other free end portions and the engaging of said cylindrical portions with said cylindrical bore preventing further transverse displacement between said one and said other free end portions.

2. In a ring binder mechanism of the type in which two ring sections are resiliently supported in pairs to form rings, the combination comprising pairs of rings sections having a non-round cross section, each ring section of a pair having free end portions, one of said free end portions of a pair comprising an external frusto-conical portion and a cylindrical portion, said external frustoconical portion having its larger diameter end joined to the respective non-round ring section and its small diameter end joined to one longitudinal end of said cylindrical portion, said smaller diameter end of said external frusto-conical portion being equal to the diameter of said cylindrical portion and being coincident with said one longitudinal end of said cylindrical portion, the other of said free end portions of a pair having a cylindrical bore and an internal frusto-concical portion opening up onto a terminating end face of said other free end portion, said internal frusto-conical portion having its smaller diameter end equal to the diameter of said cylindrical bore and coincident with one longitudinal end of said cylindrical bore, said cylindrical bore having a diameter greater than the diameter of said cylindrical portion, each of said external and internal frusto-conical portions having a cone angle of about fortyfive degrees, said cylindrical portion being insertable into said cylindrical bore to a depth at which said external frusto-conical portion mates with said internal frusto-conical portion to thereby provide a frusto-conical seating surface, said frusto-conical seatinging surface preventing initial transverse displacement between said one and said other free end portions and the engaging of said cylindrical portion with said cylindrical bore preventing further transverse displacement between said one and said other free end portions.

3. A ring binder mechanism comprising a cover, resilient support means in said cover, said resilient support means comprising two toggle plates or two toggle rods pivotably and resiliently supported in said cover, ring sections carried by said resilient support means in pairs to form rings, said ring sections having a non-round cross section, each ring section of a pair having free end portions, one of said free end portions of a pair comprising an external frusto-conical portion and a cylindrical portion, said external frusto-conical portion having its larger diameter end joined to the respective non-round ring section and its small diameter end joined to one longitudinal end of said cylindrical portion, said smaller diameter end of said external frusto-conical portion being equal to the diameter of said cylindrical portion and being coincident with one longitudinal end of said cylindrical portion, the other of said free end portions of each pair having a cylindrical bore and an internal frusto-conical portion opening up onto a terminating end face of the respective ring section, said internal frusto-conical portion having its larger diameter coincident with said end face, said internal frusto-conical portion having its smaller diameter end equal to the diameter of said cylindrical bore and coincident with one longitudinal end of said cylindrical bore, each of said external and internal frusto-conical portions having a cone angle of about forty-five degrees, said cylindrical portion being insertable into said cylindrical bore to a depth at which said external frusto-conical portion mates with said internal frusto-conical portion to thereby provide a frusto-conical seating surface which prevents transverse displacement between said seated surfaces.

4. A ring binder mechanism according to claim 3 wherein said one free end portion of said pair has a terminating end face, and a second external frusto-conical portion on said one free end portion, said second external frusto-conical portion having its smaller diameter end coincident with said terminating end face and the larger diameter end equal to the diameter of said cylinder portion and coincident with the other longitudinal end of said cylindrical portion.

* * * * *